US010006688B2

(12) United States Patent
Zuccolo et al.

(10) Patent No.: US 10,006,688 B2
(45) Date of Patent: Jun. 26, 2018

(54) DEVICE AND METHOD FOR AUTOMATICALLY PRODUCING CLEAR ICE, AND REFRIGERATOR FEATURING SUCH A DEVICE

(75) Inventors: Stefano Zuccolo, Sacile (IT); Tancredi Ingrassia, Milan (IT)

(73) Assignee: Electrolux Home Products Corporation N.V., Brussels (BE)

( * ) Notice: Subject to any disclaimer, the term of this patent is extended or adjusted under 35 U.S.C. 154(b) by 1282 days.

(21) Appl. No.: 12/447,501

(22) PCT Filed: Oct. 30, 2007

(86) PCT No.: PCT/EP2007/009385

§ 371 (c)(1),
(2), (4) Date: Feb. 9, 2010

(87) PCT Pub. No.: WO2008/052736

PCT Pub. Date: May 8, 2008

(65) Prior Publication Data

US 2010/0139295 A1 Jun. 10, 2010

(30) Foreign Application Priority Data

Oct. 31, 2006 (EP) ..... 06123270

(51) Int. Cl.
*F25C 1/24* (2018.01)
*A23G 9/12* (2006.01)
(Continued)

(52) U.S. Cl.
CPC ..... *F25C 1/20* (2013.01); *F25C 1/10* (2013.01); *F25C 2400/10* (2013.01)

(58) Field of Classification Search
CPC ..... F25C 1/00; F25C 1/18; F25C 1/12; F25C 1/20; F25C 1/10; F25C 2400/10; F25C 1/24; A23G 9/12
(Continued)

(56) References Cited

U.S. PATENT DOCUMENTS 2,233,975 A * 3/1941 Epperson ..... A23G 9/12 62/302
3,740,629 A 6/1973 Kohlhagen
(Continued)

FOREIGN PATENT DOCUMENTS

EP 0364686 4/1990
EP 0364686 A1 * 4/1990 ..... F25C 1/08
(Continued)

OTHER PUBLICATIONS

"Machine Translation of EP 0364686 A1, Gaggenau, Apr. 1990".*
International Search Report for PCT/EP2007/009385 dated Jan. 22, 2008, 2 pages.

*Primary Examiner* — Frantz Jules
*Assistant Examiner* — Martha Tadesse
(74) *Attorney, Agent, or Firm* — Pearne & Gordon LLP

(57) ABSTRACT

There is described a device (3) for automatically producing clear ice, having a water and ice-forming tray (5); a cooling device (7) located at the tray (5) to cool the water in the tray (5) to a predetermined freezing temperature; a drive unit (6) for oscillating the tray (5) about a longitudinal axis (A) of the tray (5); and a number of paddles, which are fixed inside the tray (5), and, as the tray oscillates, move the water/ice in the tray (5) in the oscillation direction of the tray.

20 Claims, 3 Drawing Sheets

(51) Int. Cl.

| | |
|---|---|
| ***F25C 1/12*** | (2006.01) |
| ***F25C 1/18*** | (2006.01) |
| ***F25C 1/20*** | (2006.01) |
| ***F25C 1/10*** | (2006.01) |

(58) Field of Classification Search
USPC ..... 62/68, 340, 342, 343, 345, 353
See application file for complete search history.

(56) References Cited

U.S. PATENT DOCUMENTS

| | | | | | |
|---|---|---|---|---|---|
| 4,184,339 | A * | 1/1980 | Wessa | F25C 1/08 | 62/342 |
| 4,199,956 | A * | 4/1980 | Lunde | F25C 1/08 | 366/241 |
| 4,943,370 | A * | 7/1990 | Gortowski | B01D 17/0214 | 210/85 |
| 5,127,236 | A | 7/1992 | von Blanquet | | |
| 5,187,948 | A | 2/1993 | Frohbieter | | |
| 5,297,394 | A | 3/1994 | Frohbieter | | |
| 5,845,513 | A * | 12/1998 | Fornasari | F25C 1/20 | 62/353 |
| 6,571,567 | B2 | 6/2003 | An et al. | | |
| 6,688,130 | B1 | 2/2004 | Kim et al. | | |
| 6,688,131 | B1 | 2/2004 | Kim et al. | | |
| 6,742,351 | B2 * | 6/2004 | Kim et al. | 62/352 | |
| 7,017,354 | B2 | 3/2006 | Lee et al. | | |
| 7,665,316 | B2 * | 2/2010 | Ito et al. | 62/135 | |
| 2006/0137382 | A1 * | 6/2006 | Sasaki | F25C 1/04 | 62/340 |
| 2006/0242986 | A1 | 11/2006 | Sugaya et al. | | |
| 2007/0163282 | A1 * | 7/2007 | Cushman | F25D 17/065 | 62/340 |
| 2009/0277191 | A1 * | 11/2009 | Heger | F25C 1/22 | 62/66 |
| 2009/0301973 | A1 | 12/2009 | Hanna | | |
| 2011/0265498 | A1 * | 11/2011 | Hall | F25C 1/08 | 62/73 |

FOREIGN PATENT DOCUMENTS

| | | | | |
|---|---|---|---|---|
| EP | 0364686 | B1 * | 3/1992 | F25C 1/08 |
| EP | 0794397 | A | 9/1997 | |
| EP | 1925894 | A1 | 5/2008 | |
| GB | 2189016 | | 10/1987 | |
| GB | 2226874 | A | 7/1990 | |
| JP | 2001221543 | A | 8/2001 | |
| JP | 2002-350019 | * | 3/2002 | |
| JP | 2006-078097 | * | 3/2006 | |
| WO | 2008052736 | A1 | 5/2008 | |

* cited by examiner

DEVICE AND METHOD FOR AUTOMATICALLY PRODUCING CLEAR ICE, AND REFRIGERATOR FEATURING SUCH A DEVICE

The present invention relates to a device and method for producing clear ice, and to a refrigerator featuring such a device.

More specifically, the present invention relates to a household refrigerator featuring a fast-operating device for producing clear ice, i.e. ice of extremely low opacity, to which the following description refers purely by way of example.

Household refrigerators are known which are fitted inside with an ice-making device normally comprising a water/ice tray inside the refrigerator; a device for feeding a given amount of water into the tray; and a cooling device comprising an evaporator located at the tray to appropriately cool/freeze the water in the tray and convert it into ice.

Some ice-making devices of the type described above also feature a drive unit for appropriately moving the tray to move the water/ice in the tray as the water is cooling. Moving the water in the tray as it is cooling/freezing, in fact, is known to remove and/or separate air bubbles and/or salts in the water to produce clearer ice.

Japanese Patent JP 2001221543, for example, describes an ice-making device with a drive unit for rotating the water tray about the longitudinal axis of the tray, so as to move the water in the tray as it is cooling.

Though efficient, the transparency and clarity of the ice produced by the above devices fail to fully meet user demand.

It is an object of the present invention to provide a device and method for producing ice of greater transparency and clarity than that produced by known ice-making devices.

According to the present invention, there are provided a device and method for producing clear ice, as defined in the accompanying Claims.

A non-limiting embodiment of the present invention will be described by way of example with reference to the accompanying drawings, in which.

The present invention is substantially based on the principle of oscillating a water tray about a respective longitudinal axis as the water in the tray is cooling; and creating specific turbulent motion of the water/ice in the tray by means of fins or paddles mounted firmly to the bottom of the tray and parallel to the longitudinal axis.

The paddles, in fact, advantageously produce rapid movement of the water/ice in the tray in the current oscillation direction, to separate air bubbles and/or salts from the ice more effectively than known devices.

Figure 1:
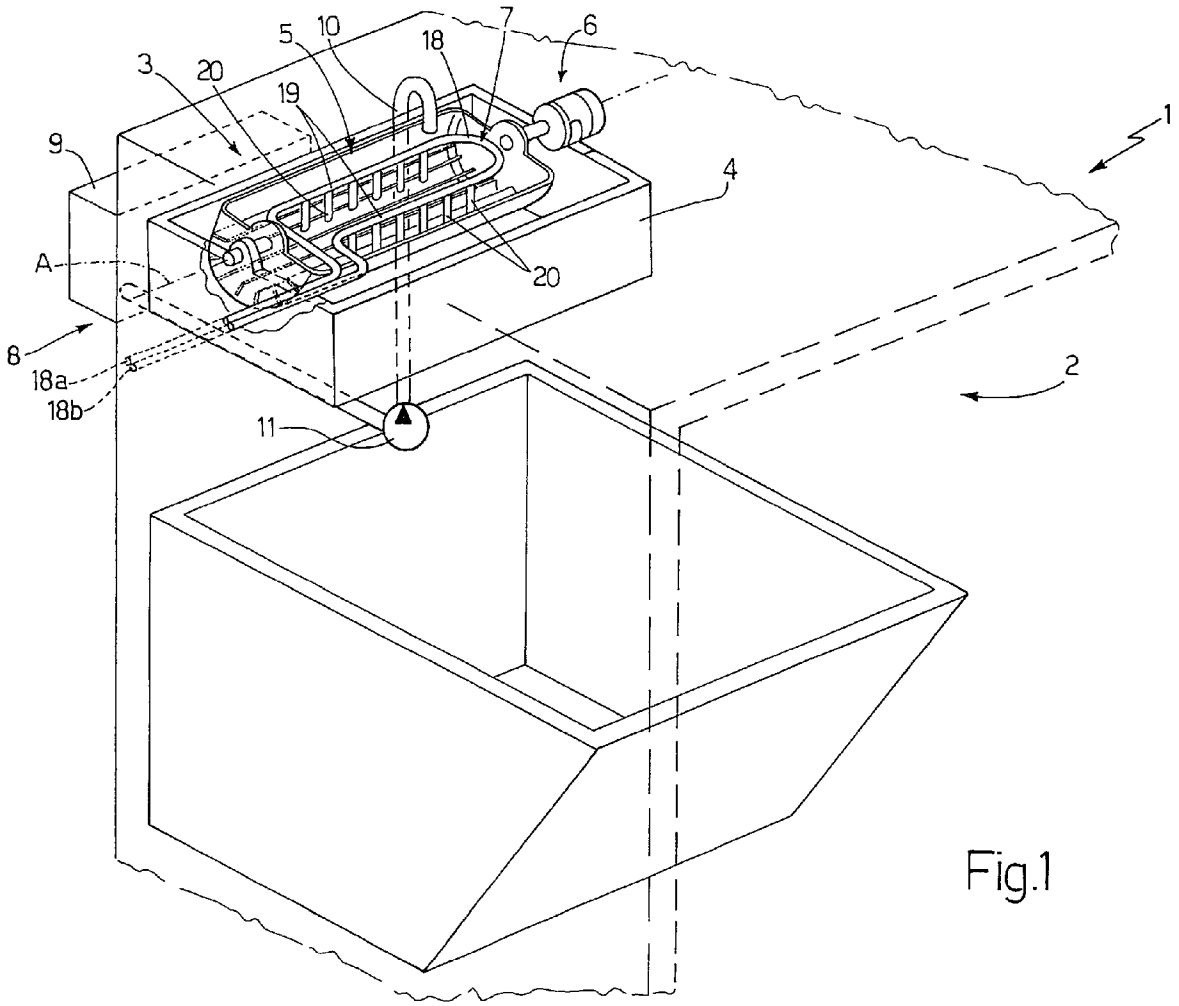
FIG. 1 shows schematically, with parts in section and parts removed for clarity, a portion of a refrigerator featuring an ice-making device for producing clear ice, in accordance with the teachings of the present invention.

Number 1 in FIG. 1 indicates as a whole a preferably, though not necessarily, household refrigerator (shown only partly for the sake of clarity) comprising, inside, one or more refrigeration compartments 2.

Refrigerator 1 comprises a fast-operating device 3 for producing clear ice, and which is housed inside one of refrigeration compartments 2 of the refrigerator—preferably, though not necessarily, the fresh-food compartment.

Device 3 substantially comprises a box-shaped container 4; a water and ice-forming tray 5 fitted to container 4 to rotate freely about a respective longitudinal axis A; and a drive unit 6, which, on command, rotates tray 5 back and forth in opposite rotation directions about longitudinal axis A to produce a predetermined oscillating movement of tray 5 about longitudinal axis A.

Device 3 also comprises a cooling device 7 located inside refrigeration compartment 2, at tray 5, to cool the water in tray 5; and a feed device 8 for feeding water into tray 5.

More specifically, with reference to the schematic example shown in FIG. 1, feed device 8 comprises a water tank 9; a feed conduit 10 connecting tank 9 to tray 5; and a pump 11 located along feed conduit 10 to pump water, on command, from tank 9 into tray 5 along feed conduit 10. Feed device 8 is known and therefore not described in detail.

With reference to FIGS. 2-5, tray 5 has a substantially semicircular cross section, crosswise to longitudinal axis A, and comprises a bottom wall 5*a* extending along longitudinal axis A; and two lateral walls 5*b* extending crosswise to longitudinal axis A and defining the ends of tray 5.

Unlike the trays of known devices, tray 5 of device 3 comprises a number of longitudinal fins or paddles 12 fixed rigidly to bottom wall 5*a* and extending parallel to longitudinal axis A. More specifically, paddles 12 are spaced apart and project radially from the inner surface of bottom wall 5*a*.

Figure 2:
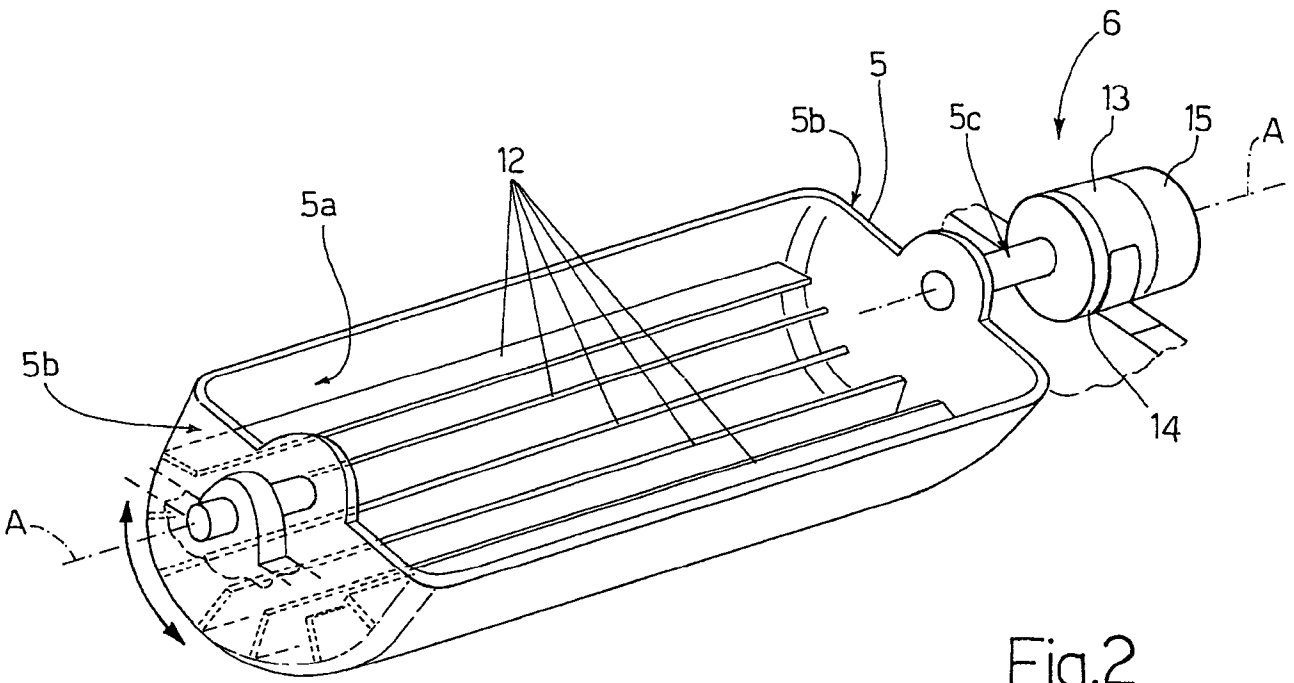
FIG. 2 shows a schematic view in perspective of a tray of the ice-making device of the FIG. 1 refrigerator.
Figure 3:
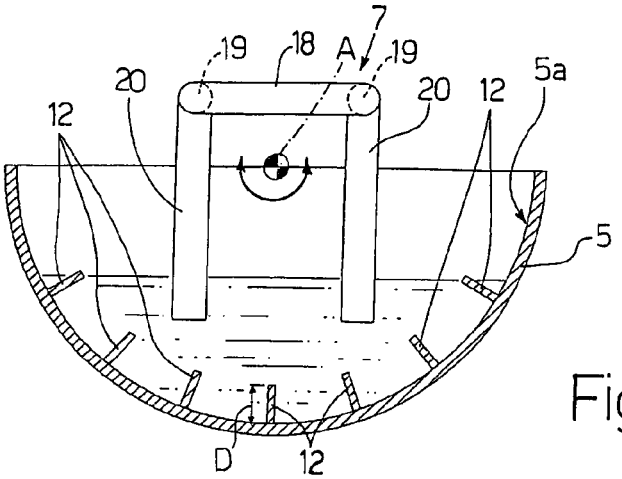
FIG. 3 shows a cross section of the FIG. 2 tray.
Figure 4:
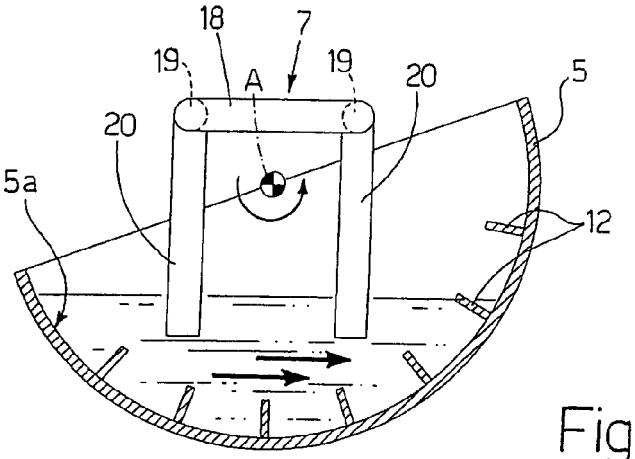
FIGS. 4 and 5 show two schematic views of the FIG. 2 tray rotated in opposite directions about its longitudinal axis.
Figure 5:
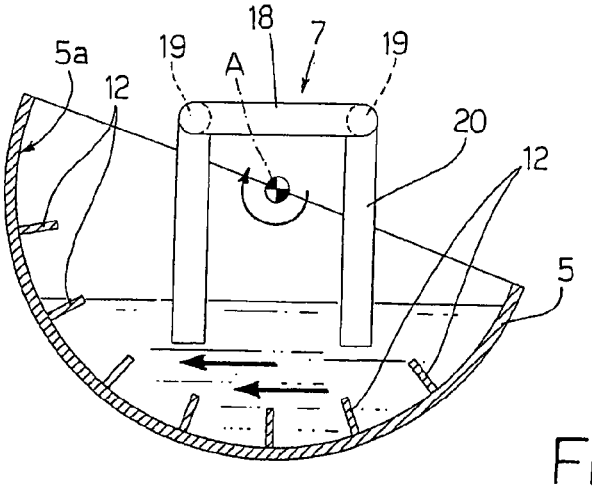

In the example shown in FIGS. 2 and 3, paddles 12 extend parallel to one another, are equally spaced, and are of a given height D with respect to the inner surface of bottom wall 5*a*.

It should be pointed out that the location of longitudinal paddles 12 inside tray 5 is extremely advantageous in forcibly moving, and so effectively agitating, the water in tray 5 as tray 5 oscillates about axis A.

That is, as tray 5 rotates, paddles 12 draw along a given amount of water between them at high speed, i.e. at the same speed at which tray 5 oscillates, whereas the rest of the water, not located between paddles 12, moves at a slower speed. The difference between the two speeds advantageously produces in tray 5 a number of streams of water flowing at different speeds, and which enhance separation of air bubbles and salts from the ice.

Drive unit 6 comprises an electric motor 13; and a transmission mechanism 14 for transmitting the oscillating movement generated by electric motor 13 on its output shaft to tray 5.

More specifically, in the example shown, electric motor 13 is controlled by an electric control unit 15 which, at predetermined intervals, changes the rotation direction of the output shaft of electric motor 13 to produce an oscillating movement of tray 5. Electric unit 15 may obviously comprise a number of position sensors (not shown) for communicating the position of tray 5 to electric unit 15, which, in this case, could control the change in the rotation direction of the motion produced by electric motor 13 as a function of the angular position of tray 5.

Transmission mechanism 14 may comprise a system of gears (not shown) meshing with one another to transmit the motion produced by electric motor 13 on its output shaft to a rotation pin 5*c* fixed to lateral wall 5*b* of tray 5 and coaxial with longitudinal axis A.

Finally, cooling device 7 comprises an evaporator, which is appropriately connected to a compression and condensing circuit (not shown), is housed inside container 4 and/or refrigeration compartment 2 of refrigerator 1, and is positioned facing the opening of tray 5 to freeze the water in tray 5 into ice.

Cooling device 7 comprises a finger evaporator, in turn comprising a coolant circulating conduit 18, which, in the FIG. 1 example, has two parallel branches 19 directly facing the opening of tray 5; and a number of ice-forming fingers or projecting members 20 extending from conduit 18 towards tray 5 and immersed in the water in the tray.

More specifically, the two branches 19 are series-connected, have a coolant inlet 18*a* and outlet 18*b*, and extend parallel to longitudinal axis A; whereas the ice-forming fingers or projecting members 20 project from respective branches 19, in a direction substantially crosswise to longitudinal axis A, into the space inside tray 5 and towards bottom wall 5*a*.

In actual use, feed device 8 feeds water into tray 5. During formation of the ice, control unit 15 activates electric motor 15 to oscillate tray 5 about longitudinal axis A, and, at the same time, activates cooling of the coolant of the evaporator which in turn cools/freezes the water surrounding projecting members 20.

As the tray oscillates, the evaporator remains in a predetermined position, i.e. stationary with respect to tray 5, which, as it oscillates, produces a relative movement between the water/ice inside it, which tends to move in the current oscillation direction, and projecting members 20 of the evaporator, which are bathed repeatedly by the water/ice.

More specifically, "entrainment" of a certain amount of water/ice in the current oscillation direction is assisted by paddles 12, which move the water in tray 5 back and forth in one direction (FIG. 4) and then another (FIG. 5) to produce turbulent motion of the water in both directions.

The turbulent motion so formed improves separation of air bubbles and salts from the ice, thus making the ice clearer and more transparent.

The ice-making method therefore substantially comprises the steps of:

feeding a certain amount of water into tray 5;

cooling the water in the tray by means of cooling device 7 comprising a finger evaporator;

as the water in tray 5 cools, rotating tray 5 back and forth, about longitudinal axis A, between a first and second limit angular position.

More specifically, tray 5 is rotated by electric motor 13 back and forth to oscillate about axis A. And, as tray 5 oscillates, paddles 12 move a given amount of water back and forth, in the two opposite rotation directions, at a faster speed than the rest of the water in the tray not located between the paddles 12, so as to effectively stir the water/ice and achieve the formation of extremely clear, transparent ice.

The device described above is extremely advantageous, by virtue of paddles 12 on bottom wall 5*a* of tray 5 producing rapid movement of the water in tray 5, and hence turbulent motion which provides for obtaining clearer, more transparent ice than that produced by known ice-making devices.

Clearly, changes may be made to the device, to the refrigerator, and to the method of producing clear ice, as described and illustrated herein without, however, departing from the scope of the present invention as defined in the accompanying Claims.

The invention claimed is:

1. A device for automatically producing clear ice, comprising:

a water and ice-forming tray comprising a number of paddles located inside the tray and extending parallel to a longitudinal axis of the tray, the tray having an open top;

a drive unit configured to oscillate the tray about the longitudinal axis of the tray during a cooling of the water to a predetermined freezing temperature, the paddles of the tray being configured to move water in the tray in a direction in which the tray is being oscillated by the drive unit; and at least one cooling device located at the tray to cool the water in the tray to the predetermined freezing temperature, wherein the paddles extend from a bottom wall of the tray for hindering flow between the paddles and the bottom wall and are stationary with respect to the tray.

2. The device of claim 1, wherein the tray has a substantially semicircular cross section, crosswise to said longitudinal axis; said paddles being parallel to one another, and spaced apart on the bottom wall of the tray.

3. The device of claim 1, wherein said cooling device comprises an evaporator, in turn comprising at least one coolant circulating conduit located at the opening of said tray, and a number of projecting freezing members projecting from said conduit through the open top of the tray so as to contact the water/ice in the tray.

4. The device of claim 3, wherein the conduit of said evaporator comprises at least one cooling branch, which extends facing and adjacent to the opening of said tray, extends parallel to the longitudinal axis, and supports said projecting freezing members.

5. A refrigerator, comprising the device for automatically producing clear ice as claimed in claim 1.

6. A method of automatically producing clear ice, comprising the steps of:

cooling water in a tray having an open top to a predetermined freezing temperature by means of a cooling device comprising an evaporator located at the tray;

oscillating said tray about a longitudinal axis of the tray during said step of cooling the water;

moving the water in said tray in a direction in which the tray is oscillating during the oscillating of said tray by means of a number of paddles extending from and fixed to a bottom wall of the tray for hindering flow between the paddles and the bottom wall, wherein the paddles are stationary with respect to the tray.

7. The device of claim 1, wherein the paddles are positioned only at an inner surface of the bottom wall of the tray.

8. The device of claim 1, wherein the paddles are configured to draw an amount of the water between them at a speed at which the tray is being oscillated by the drive unit while a remainder of the water that is not located between the paddles moves at a slower speed.

9. The device of claim 1, wherein the drive unit is configured to oscillate the tray in a first rotation direction and a second rotation direction that is opposite to the first rotation direction.

10. The device of claim 1, wherein the paddles are configured to move a portion of the water in the tray disposed between the paddles in a direction corresponding to the direction in which the tray is being oscillated by the drive unit.

11. The device of claim 1, wherein the drive unit is configured to oscillate the tray between a first limit angular position and a second limit angular position.

12. The device of claim 1, wherein the drive unit is configured to repeatedly oscillate the tray about the longitudinal axis of the tray during the cooling of the water to the predetermined freezing temperature.

13. The device of claim 1, further comprising:

an electric control unit configured to control the drive unit to oscillate the tray.

14. The device of claim 13, further comprising:

position sensors configured to detect a position of the tray and communicate the detected position of the tray to the electric control unit.

15. The device of claim 14, wherein the electric control unit is further configured to control the drive unit according to the detected position of the tray.

16. The device of claim 1, wherein the paddles of the tray move the water in the tray to separate air bubbles and salt from the water.

17. The method of claim 6 further comprising a step of:

separating air bubbles and salt from the water by means of the number of paddles.

18. The device of claim 1, wherein the paddles are free of holes.

19. The method of claim 6, wherein the paddles are free of holes.

20. The method of claim 6, wherein said step of moving the water in said tray includes moving the water over a number of projecting freezing members projecting through the open top of the tray.

* * * * *